US005389059A

United States Patent [19]

Corwin

[11] Patent Number: 5,389,059

[45] Date of Patent: Feb. 14, 1995

[54] HONEYCOMB STRUCTURAL MATERIAL

[76] Inventor: Charles H. Corwin, P.O. Box 689, Ketchum, Id. 83340

[21] Appl. No.: 918,269

[22] Filed: Jul. 22, 1992

[51] Int. Cl.[6] ..... B65H 45/22; B65H 45/28; B65H 45/30

[52] U.S. Cl. ..... 493/355; 493/356; 493/399; 493/968; 493/966

[58] Field of Search ..... 493/333, 335, 355, 356, 493/363, 399, 407, 458, 463, 464, 966, 968; 156/197, 198, 474

[56] References Cited

U.S. PATENT DOCUMENTS

| | | | |
|---|---|---|---|
| 1,389,294 | 8/1921 | Dean | 156/197 |
| 2,046,985 | 7/1936 | Wilkins | 493/966 |
| 2,553,054 | 5/1951 | Lincoln | 156/474 |
| 2,933,122 | 4/1960 | Christman | 493/966 |
| 3,011,672 | 12/1961 | Vesak | 156/197 |
| 3,018,205 | 1/1962 | Barut | 156/197 |
| 3,752,089 | 8/1973 | Bartels . | |
| 3,753,843 | 8/1973 | Hotchinson . | |
| 3,951,730 | 4/1976 | Wennberg et al. . | |
| 4,012,932 | 3/1977 | Gewiss | 493/463 |
| 4,792,325 | 12/1988 | Schmidtke | 493/397 |

*Primary Examiner*—Jack W. Lavinder
*Attorney, Agent, or Firm*—Frank J. Dykas; Craig M. Korfanta

[57] ABSTRACT

A honeycomb structural material formed from flat sheet material 60 by establishing a plurality of channels along parallel channel fold lines 68 and reverse channel fold lines 74 and reverse channel cuts 70. A spaced array of holes 66 are cut in the top surfaces 86 of the channels with triple point fold lines 72 formed in top surface 62 and side wall fold lines 74 formed in bottom surface 64. With all fold lines formed flat sheet 60 is folded into plurality of channels and compressed along the axis of the channels to form the honeycomb structure.

5 Claims, 9 Drawing Sheets

HONEYCOMB STRUCTURAL MATERIAL

BACKGROUND OF THE INVENTION

1. Technical Field

This invention relates to a honeycomb structural material, and more particularly to a honeycomb structural material which can be formed of a single sheet of flat material without the need of fastening multiple pieces of material together.

2. Background Art

Honeycomb structural material is used in a variety of applications which range from floor grates, stair treads and sidewalks to grills, louvered panels to load-bearing surfaces for holding other solid panels in spaced relationship, such as structural rigidity for hollow-core doors and sidewalls of cargo containers. They are also used as heat sinks by increasing heat-radiating surface area, or conversely, as in insulation applications, by providing an air barrier between two walls. And finally, they can even be used in a soil stabilization function if they are integrated into the soil surface of an embankment prior to final finish grading of the soil.

The problem is that honeycomb structural material has always been rather difficult to fabricate and bulky to transport because it is usually formed of a plurality of separate pieces which are somehow fastened together to form the honeycomb material at a fabrication plant remote from the final place of use.

Bartels, U.S. Pat. No. 3,752,089 teaches a load-bearing assembly which utilizes a plurality of sub structures scored along longitudinal lines to form individual rectangular sections which are then folded and joined to form a box tube unit. Hutchison, U.S. Pat. No. 3,753,843 teaches a similar structure, except that it takes two sub structures fastened together to form the honeycomb structure. Wennberg et al., U.S. Pat. No. 3,951,730 is yet another development, but it still requires multiple pieces being fastened together to form the honeycomb structural material.

In all of the prior art, multiple pieces are used to form a honeycomb structure. Thus, in all cases, spot welding, lamination, gluing or some other fabrication step is required to form honeycomb structural material, thus making it difficult for on-site assembly.

What is needed then is a method of forming honeycomb material having a plurality of polyhedrons from a single sheet of material without the necessity of fastening sub parts or sub structures together.

DISCLOSURE OF INVENTION

These objects are accomplished by scoring or forming, in a single flat sheet of material, a number of fold lines and a plurality of holes in a spaced array. Although the following steps can be accomplished in any order, for the sake of clarity, they are presented as follows: First, a plurality of parallel reverse channel fold lines are formed in the top surface of a sheet of flat material along a longitudinal axis, and a plurality of parallel channel fold score lines are formed in the under surface of the material so that when the material is bent along the scored fold lines, a plurality of parallel U shaped channels are formed with each channel having a top surface coincident to a longitudinal axis and two parallel downwardly extending vertical side surfaces with the top surface of the sheet forming the outer surfaces of the parallel channels and the bottom surface forming the inner surfaces of each channel.

A plurality of top surface openings, which extend completely from the fold lines of the vertical side walls are cut into a flat sheet of material in position such that they are interspaced between sections of the remaining top surface when the channels are formed.

Next, there is established on the top surface scored or fold lines in each of the sections of the sheet that are to become the vertical sidewalls, at a location adjacent to the triple points of each of the top surface holes in orientation perpendicular to the longitudinal axes. This is followed by scoring, in the bottom surface of the sheet, for each opening in the top surface, at least a pair of fold lines in each of the opposing two sections of the sheet that are to be the vertical sidewalls adjacent to each opening, said fold lines being perpendicular to the longitudinal axis and in juxtaposed parallel relationship and further being centered equal distance from the center points of each of the top surface openings.

Once these holes and fold lines have been established, the flat sheet of material can then be folded into a multiple parallel channel structure with the top surface of the material becoming the outer surfaces of each channel and the bottom surface becoming the inner surfaces of each channel. Once this is accomplished, the channels are compressed along the longitudinal axis, thus causing the material to bend or fold along each fold line to create a honeycomb structure material having a plurality of similar polygons centered about the center points of each of the openings.

In a second embodiment the top surfaces and top surface openings are eliminated and instead of two channel fold lines defining the top surfaces and side walls, a single channel fold line, scored in the lower surface, is provided and the top surface openings are replaced with channel cuts, which when compressed open to form the similar polygons of the honeycomb structure.

BEST MODE FOR CARRYING OUT INVENTION

Figure 1:
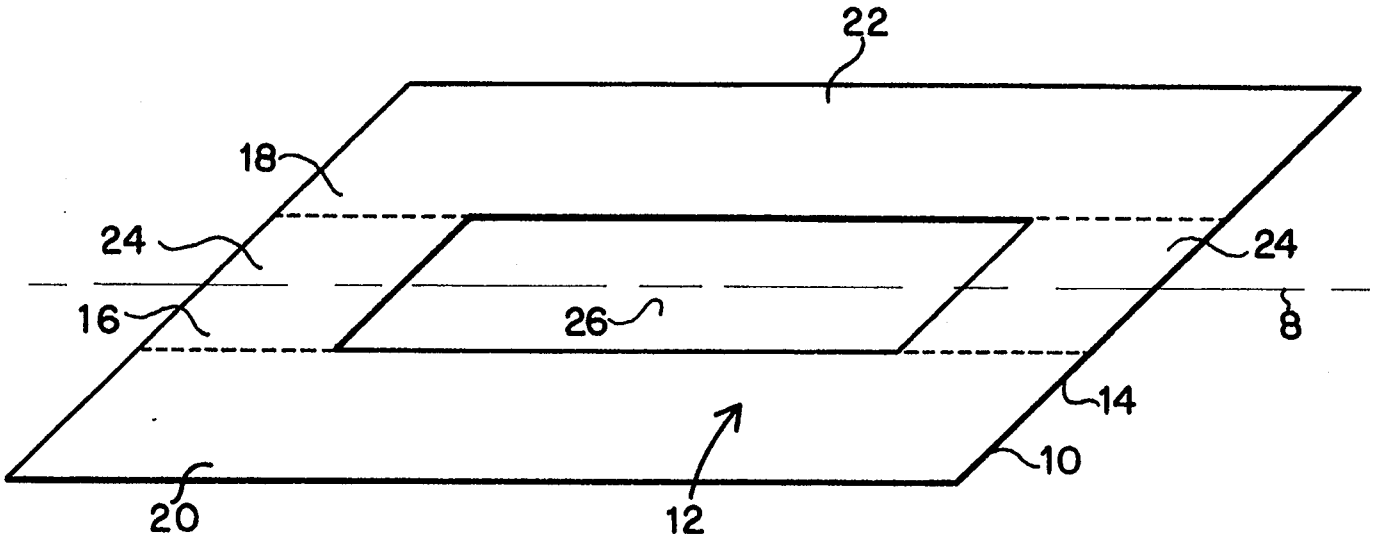
FIG. 1 is a parallel respective representation of a flat sheet of material for forming a single similar polyhedron structure.
Figure 2:
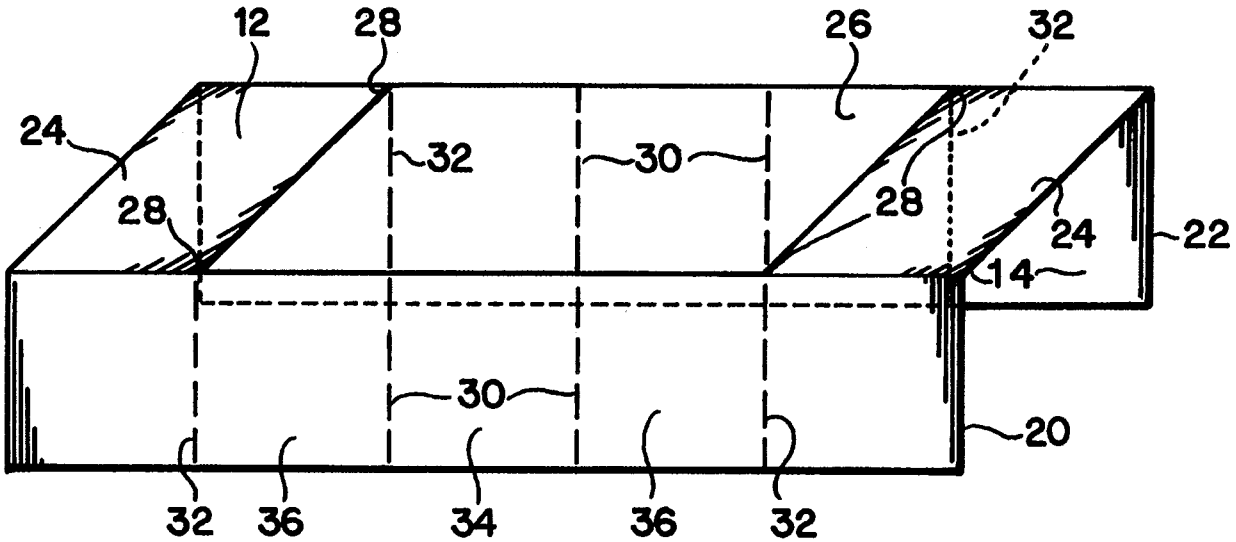
FIG. 2 is a flat sheet of material folded to form a channel for a single similar polyhedron structure.
Figure 3:
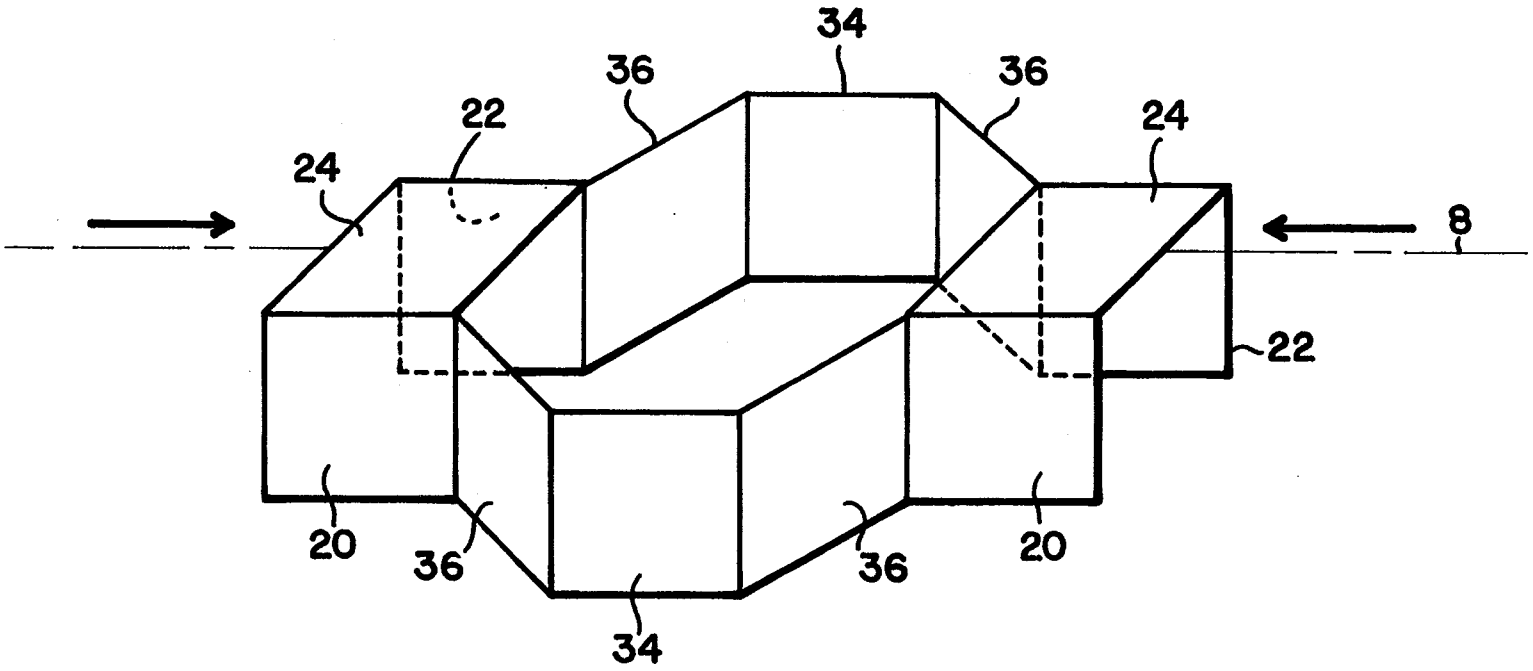
FIG. 3 is a compressed polyhedron structure.
Figure 4:
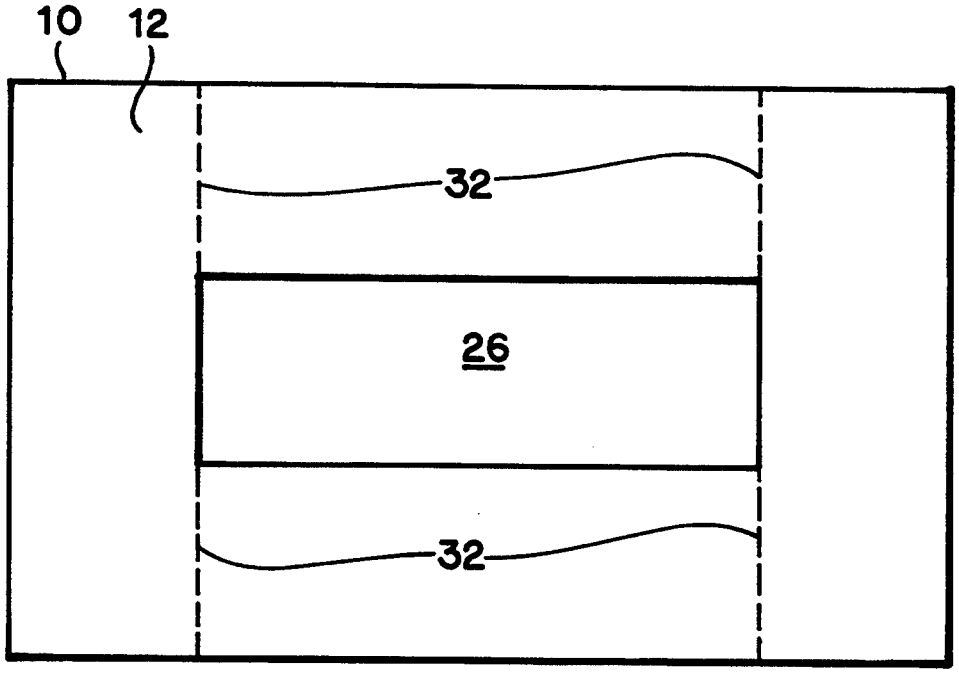
FIG. 4 is a top plan view of the single sheet of material for forming a single polyhedron structure.
Figure 5:
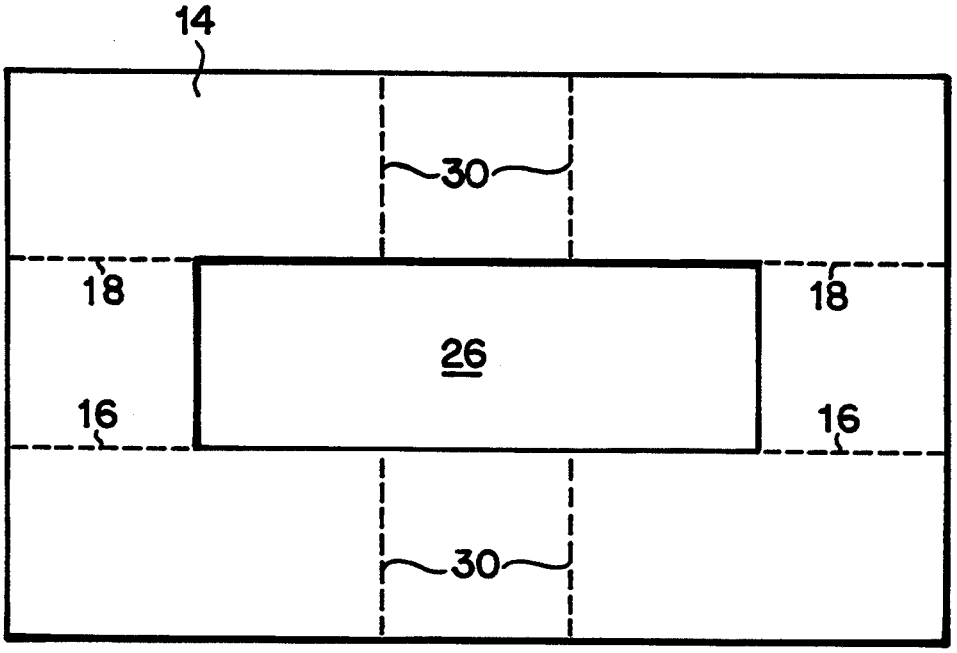
FIG. 5 is a bottom plan view of the single sheet of material for forming a single polyhedron structure.

The invention, in its simplest embodiment, is shown in FIGS. 1 through 5. A flat sheet of material, 10, as shown in FIGS. 1, 4 and 5, has fold lines 16 and 18 formed within it on the lower surface 14. Fold lines 16 and 18 divide sheet 10 to define the three surfaces of the eventual channel shaped form as shown in FIG. 2. These surfaces are top surface 24, and vertical sidewall surfaces 20 and 22.

In the preferred method of manufacture, formed simultaneously with the fold forming operation, is hole 26 in top surface 24. Hole 26, as is shown in FIGS. 1 and 2, spans across the entire width of top surface 24 so as to form triple points 28, as shown in FIG. 2, when vertical sidewalls 20 and 22 are folded over to form a channel shaped structure.

As shown in FIGS. 2, 3 and 4, at the same times as channel fold lines 16 and 18 are formed on lower surface 14 of flat sheet 10, there are also formed sidewall fold lines 30 on lower surface 14 and on upper surface 12, triple point fold lines 32.

In practice, the fold lines and hole 26, as shown in FIGS. 4 and 5, are all formed simultaneously in a single operation.

Vertical sidewalls 20 and 22 are then folded over to form the U shaped channel, as shown in FIG. 2, and then, as shown in FIG. 3, compressive force is applied coincident to the centerline, from both directions toward the center point of hole 26. This compressive force forces the vertical side walls 20 and 22 to bend along fold lines 30 and triple point lines 32, to form a similar polyhedron having two parallel side panels 34 and four angular side panels 36.

Figure 6:
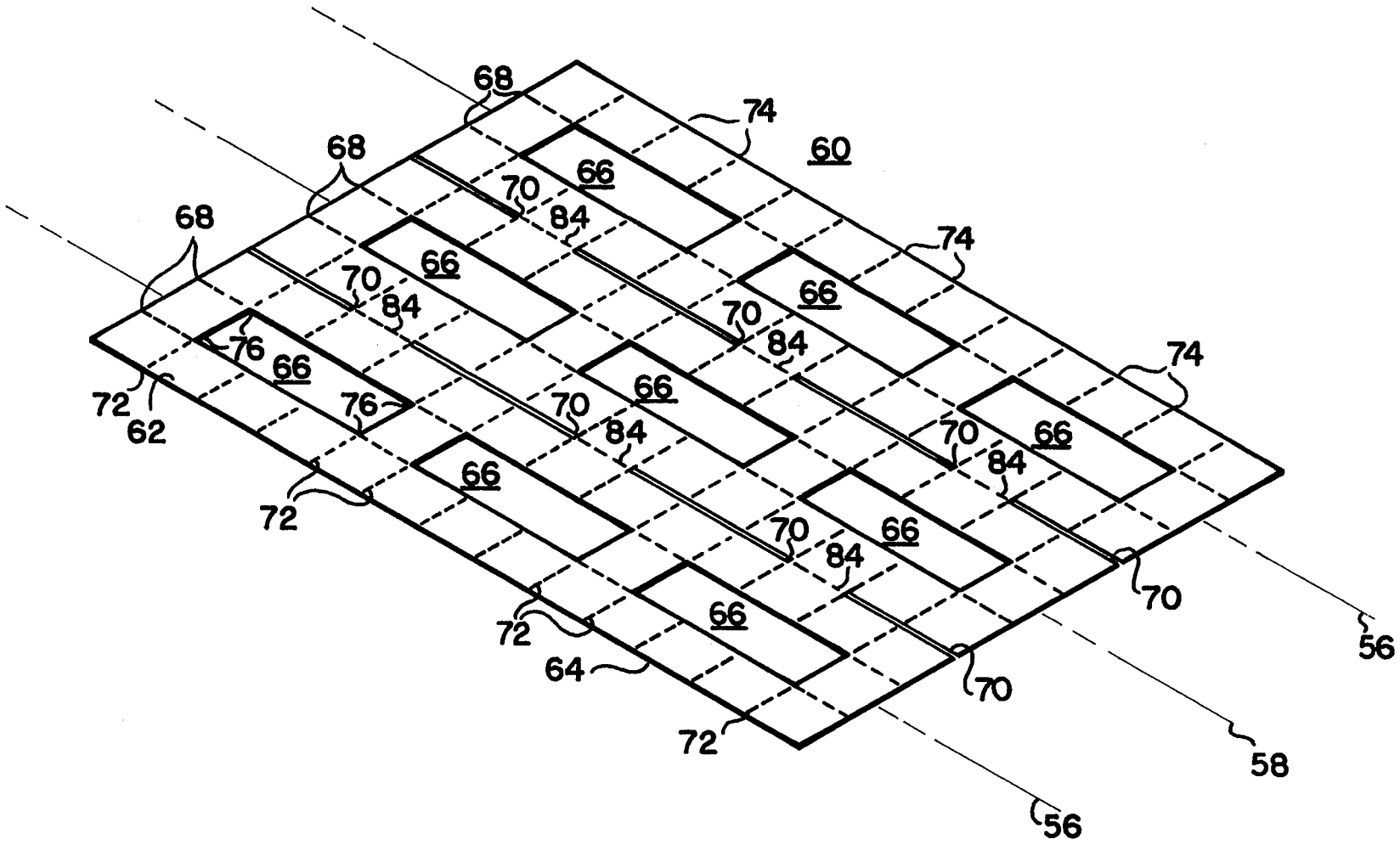
FIG. 6 is a perspective representational view of a flat sheet of material for forming a multiple polyhedron structure.
Figure 7:
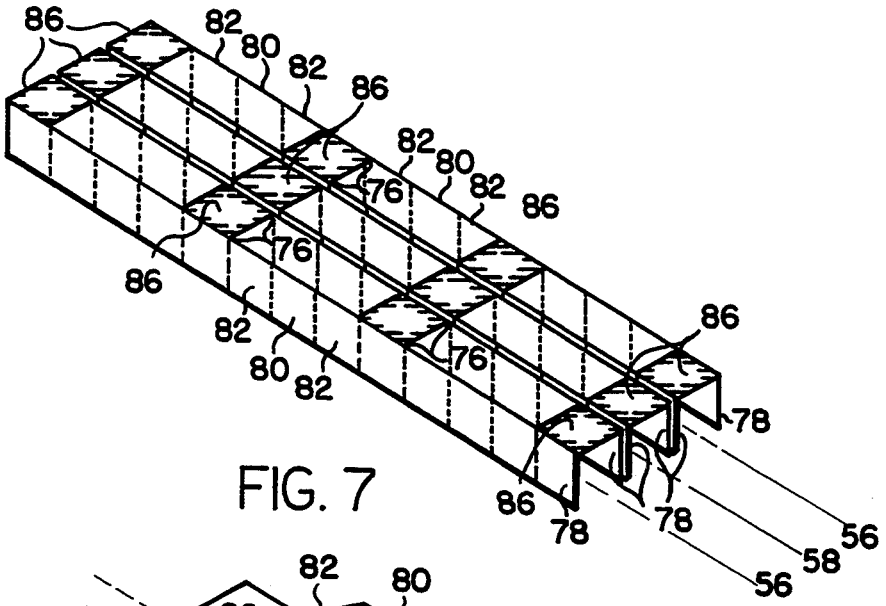
FIG. 7 is a perspective representational view of a flat sheet of material for forming a multiple polyhedron structure folded into multiple channels.
Figure 8:
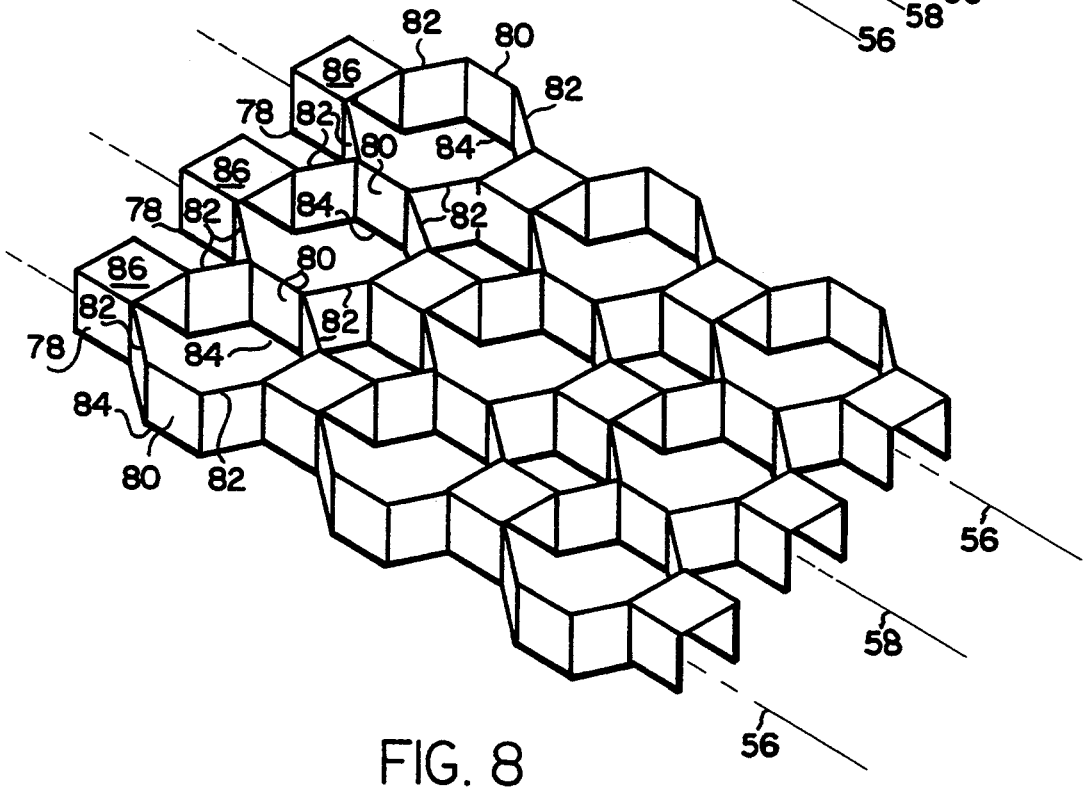
FIG. 8 is a compressed multiple polyhedron structure.
Figure 9:
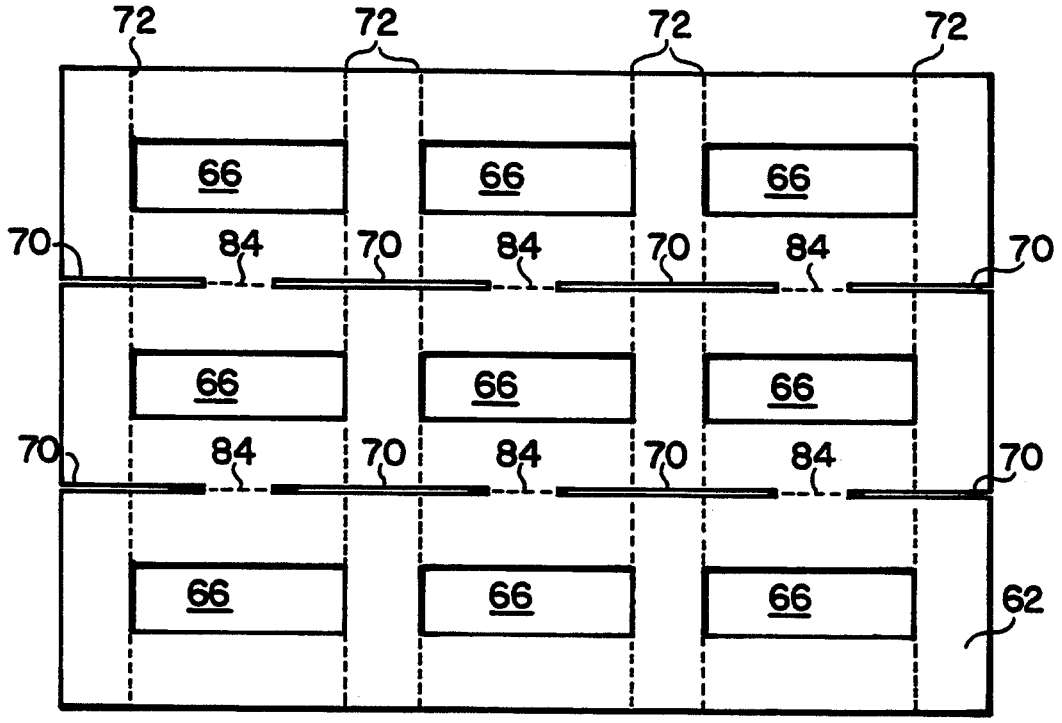
FIG. 9 is a top plan view of a flat sheet of material for forming a multiple polyhedron structure showing the fold lines.
Figure 10:
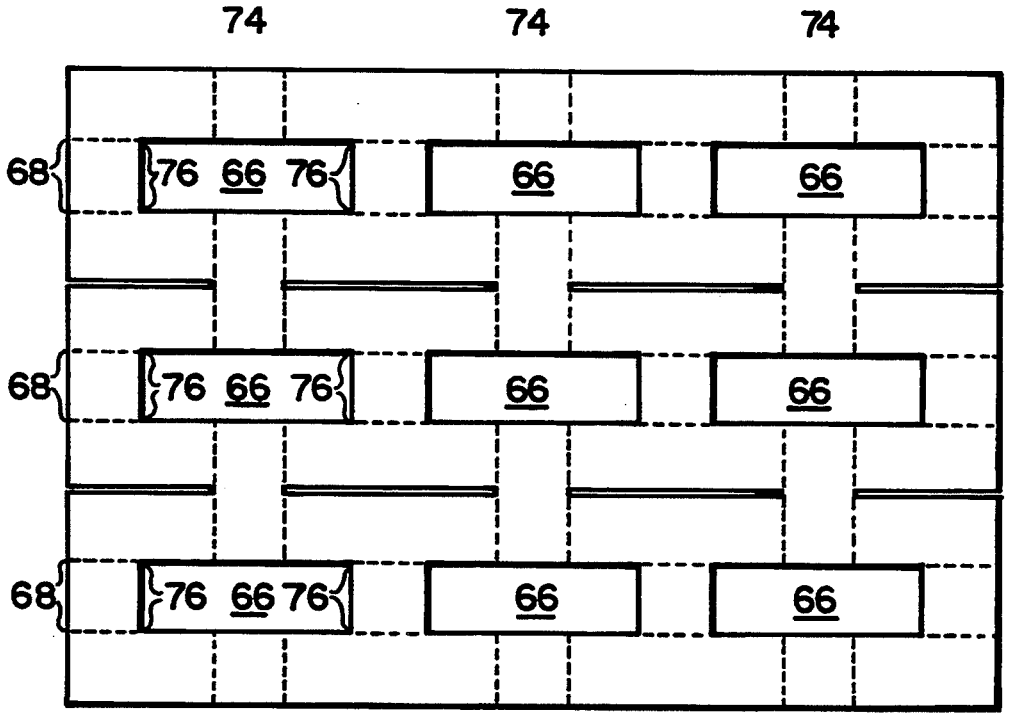
FIG. 10 is a bottom plan view of a flat sheet of material for forming a multiple polyhedron structure showing the fold lines.
Figure 11:
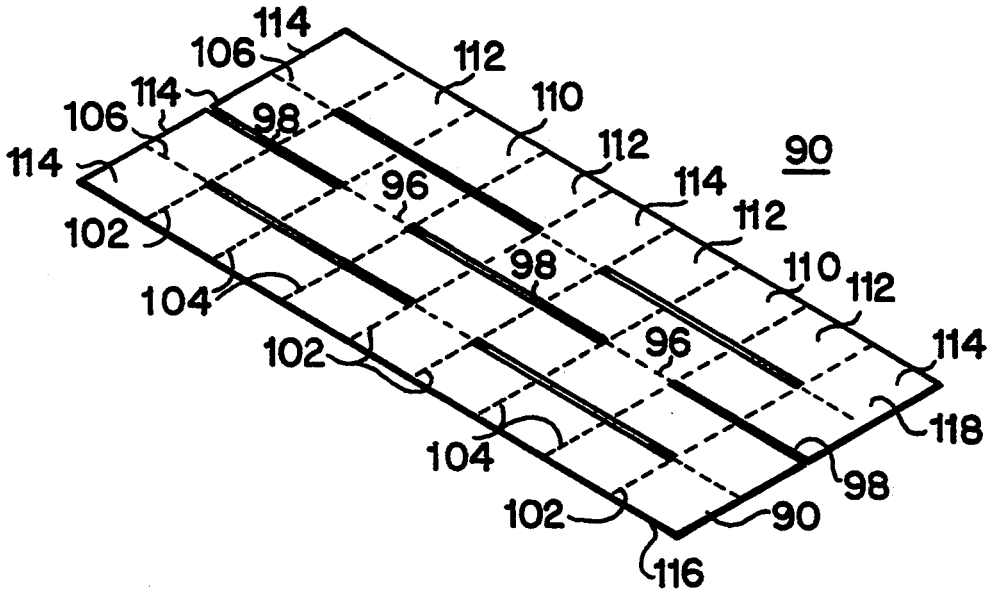
FIG. 11 is a perspective representational view of a flat sheet of material for forming a second embodiment of a multiple polyhedron structure.
Figure 12:
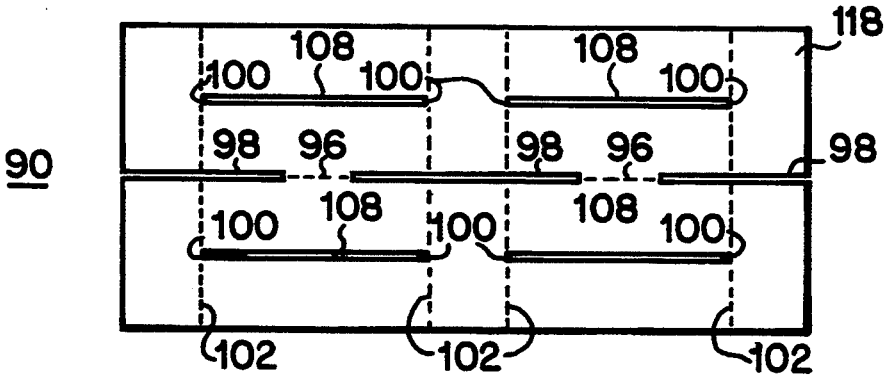
FIG. 12 is a top plan view of a flat sheet of material for forming the second embodiment of a multiple polyhedron showing the cut and top scored fold lines.
Figure 13:
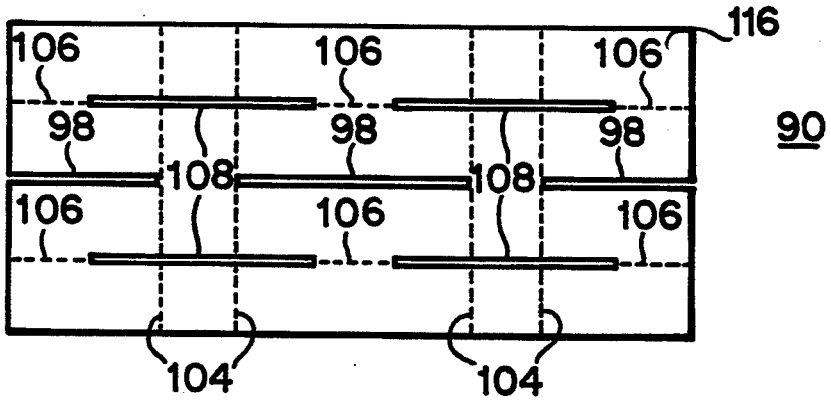
FIG. 13 is a bottom plan view of a flat sheet of material for forming the second embodiment of a multiple polyhedron showing the cut and bottom scored fold lines.

FIGS. 6 through 10 disclose a more complex embodiment of the same invention. As can be seen in FIGS. 6 and 10, a series of parallel reverse channel cuts 70 and reverse channel fold lines 84 are formed in upper surface 62 of a sheet of flat stock material. On the bottom surface 64 are formed channel fold lines 68 which are parallel to reverse channel fold cuts 70 and reverse channel fold lines 84, so that the flat stock material 60 can be folded to form a plurality of separate, parallel channels, as shown in FIG. 7. Reverse channel cuts 70 are sized and located such that reverse channel fold lines 84 only exist between adjacent parallel side panels 80 which will eventually exist as the honeycomb structural material is formed of the flat stock, and as is shown in FIG. 8.

A plurality of holes 66 are cut in flat sheet 60 in the spaced array fashion in what eventually will become top panels 86. Each hole 66 spans the entire width of what will become top panels 86 so as to form triple points 76 at the corner points where the remaining top panel surfaces 86 join vertical side walls 78 and holes 66. Triple point fold lines 72 are also formed in the top surface 62 as shown in FIGS. 6 and 9, which, in conjunction with side wall fold lines 74 form the bottom surface 64, defined, at each hole 66, what are to become parallel side panels 80, and adjacent angular side panels 82, as shown in FIG. 7.

All of these steps outlined above can be accomplished in any sequential order, as long as the end flat sheet material has the requisite fold lines, channel cuts and holes formed therein. Once formed, flat sheet 60 is then manipulated to form the parallel channels shown in FIG. 7 having centerline 58, and, in the example herein described, two parallel axis 56. The final step necessary to form the honeycomb structural material is the application of compressive force coincident to the parallel central axis 58 and parallel axis 56, which results in the formation of an array of similar polyhedrons held together at reverse channel fold line 84 as is shown in FIG. 8.

FIGS. 11 through 14 disclose a second embodiment of this invention. In this second embodiment reverse channel fold lines 96 and reverse channel fold cuts 98 are formed in upper surface 118 in a manner similar to that of reverse channel fold and cut lines 84 and 70 of the first embodiment. The primary difference is that the paired channel fold lines 68 and the resulting top panels 84 of the first embodiment are replaced with a single channel fold line 106 formed in lower surface 116, and holes 66 are replaced with channel fold cuts 108.

In this second embodiment, the end points 100 of each channel cut functions the same as triple points 76 and intersect with triple point fold lines 102 which are formed in top surface 118. Side wall fold lines 104 are formed in lower surface 116 at locations equidistant from the center point of each channel fold cut 108.

Figure 14:
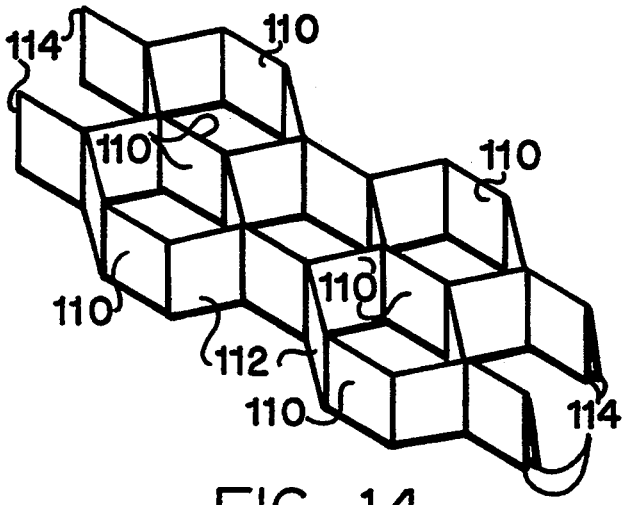
FIG. 14 is a perspective representational view of the compressed second embodiment of the multiple polyhedron structure.

Flat sheet 90 is then folded along channel fold lines 106 and reverse channel fold lines 96 to form an accordion like structure. Then when it is compressed the material unfolds along the triple point fold lines 102 and sidewall fold lines 104 to form a spaced array of similar polyhedrons as shown in FIG. 14.

The ability to form honeycomb structural material from a single sheet provides some unique advantages in a number of different applications. For example, steel grating for use on walkways, stairways, elevated platforms and the like, or as load-bearing ventilation system grating can be formed in a single stamping operation without the necessity of fastening multiple polygons together by spot welding or the like. In a like manner, honeycomb structural material can be formed of plastics or polymers without the need for the use of gluing or other bonding techniques.

Another unique advantage is that the holes and the cut lines can be cut, and the folds scored in the material at one location, and then shipped to a second location, in bulk, as flat-sheet material, where it can be folded and compressed to form the honeycomb structure as needed. For example, cardboard stock material can be cut and scored at a paper mill and shipped in bulk, as flat sheet material, to a hollow-core door manufacturer, where it can be folded and compressed to form honeycomb structural material for use between the panels of hollow-core doors as needed. In a similar fashion, biodegradable cardboard material could be used in landscaping applications, being shipped to the job site as flat sheet material, then folded and pressed to form honeycomb structural material, which can be laid down on embankments prior to the final backfilling to provide temporary biodegradable erosion control.

While there is shown and described the present preferred embodiment of the invention, it is to be distinctly understood that this invention is not limited thereto but may be variously embodied to practice within the scope of the following claims.

I claim:

1. A method of forming a honeycomb structural material from a single flat sheet of material having a first planar surface, a second planar surface and a longitudinal axis which comprises, in any order:

establishing a pair of fold lines in the second planar surface for forming three panels from the flat sheet of material, a top central surface panel, a first side panel to one side of the central rod surface panel and second side panel to the opposite side of the central top surface panel, each having a longitudinal axis parallel to the longitudinal axis of the sheet of material;

cutting a generally rectangular opening in a portion of the central top surface panel, said generally rectangular opening having a center point and spanning completely from the first side panel to the second side panel and being bounded on two opposing sides by the first and second side panels and on the remaining two opposing sides by remaining portions of the central top surface panel;

establishing, in the second planar surface of the sheet, for the generally rectangular opening in the central top surface panel, at least a pair of fold lines in the first and second side panels adjacent to the opening, said fold lines being perpendicular to the longitudinal axis and in juxtaposed parallel relationship, said fold lines being located equidistant from the center point of the generally rectangular opening;

establishing fold lines in the first and second side panels of the sheet at the intersection where the first and second side panels and the ends of the generally rectangular opening bounded by the remaining two opposing sides of the central top surface panel intersect;

folding the sheet of material into a U-shaped channel structure with the first planar surface becoming the outer surface of the channel and the second planar surface becoming the inner surface of said channel, the central top surface panel becoming the base of the U-shaped channel and the first and second side panels becoming the sides of the U-shaped channel; and compressing the channel structure along its longitudinal axis to form a polygon concentric about the center point of the opening.

2. The method of claim 1 which further comprises holding in compression the channel structure.

3. A method of forming a honeycomb structural material from a single flat sheet of material having a first planar surface, a second planar surface and a longitudinal axis which comprises, in any order:

establishing fold lines in the first and second planar surfaces for forming a plurality of rows of panel in the sheet of material, each triad having a central top surface panel, a first side panel to one side of the central top surface panel, and a second side panel to the opposite side of the central top surface panel; having a longitudinal axis parallel to the longitudinal axis of the sheet of material;

cutting a parallel array of generally rectangular openings in the central top surface panels of each panel triad, said generally rectangular openings having a center point and spanning completely from the first side panel of each triad to the second side panel of each triad and being bounded on two opposing sides by the first and second side panels and on the remaining two opposing sides by remaining portions of the central top surface panel;

establishing, in the second planar surface of the sheet, for each generally rectangular opening in the central top surface panel, at least a pair of fold lines in the first and second side panels of each panel triad adjacent to the openings, said fold lines being perpendicular to the longitudinal axis and in juxtaposed parallel relationship, said fold lines being located equidistant from the center points of each of said generally rectangular openings;

establishing fold lines in the first and second side panels of each panel triad, at the intersection where the first and second side panels and the ends of the generally rectangular openings bound by the remaining two opposing sides of the central top surface panels intersect;

cutting the sheet of material along the fold lines formed between the first and second side panels of adjacent panel triads except for those portions of the fold lines that connect adjoining portions of side panels which form parallel sides of similar polygons parallel to the longitudinal axis of the sheet of material and the panel triads; and then, folding the rows of panel triads into a plurality of U-shaped channel shaped structures with the first planar surface becoming the outer surface of the channels and the second planar surface becoming the inner surface of said channels, the central top surface panel becoming the base of the U-shaped channels and the first and second side panels becoming the sides of the U-shaped channels; and compressing the channel structures along their longitudinal axes to form similar polygons centered about the center points of each of the openings.

4. The method of claim 3 which further comprises holding the channel structures in compression.

5. The method of claim 3 which further comprises fastening together the adjoining portions of side walls.

* * * * *